United States Patent [19]

Robbins

[11] Patent Number: 4,634,313

[45] Date of Patent: Jan. 6, 1987

[54] PIPE LAYING AND REPLACEMENT

[75] Inventor: Brian A. Robbins, Maidstone, England

[73] Assignee: Water Research Centre, England

[21] Appl. No.: 679,060

[22] Filed: Dec. 6, 1984

[30] Foreign Application Priority Data

Dec. 8, 1983 [GB] United Kingdom ..... 8332738

[51] Int. Cl.[4] ..... F16L 1/00; E21B 1/00

[52] U.S. Cl. ..... 405/184; 405/154; 138/97; 254/29 R

[58] Field of Search ..... 405/154, 184; 138/97; 254/29 R; 175/53, 62, 19, 22, 293

[56] References Cited

U.S. PATENT DOCUMENTS

| | | | |
|---|---|---|---|
| 3,474,873 | 10/1969 | Zygmunt | 175/19 |
| 3,730,283 | 5/1973 | Kostylev et al. | 175/53 |
| 4,027,854 | 6/1977 | Mounton, Jr. | 254/29 R |
| 4,067,200 | 1/1978 | Watts . | |
| 4,368,785 | 1/1983 | Gondek | 175/21 |
| 4,403,890 | 9/1983 | Miyanagi et al. | 405/184 |
| 4,505,302 | 3/1985 | Streatfield et al. | 405/184 X |
| 4,507,019 | 3/1985 | Thompson | 138/97 X |

FOREIGN PATENT DOCUMENTS

| | | | |
|---|---|---|---|
| 0060124 | 9/1982 | European Pat. Off. . | |
| 86567 | 8/1983 | European Pat. Off. . | |
| 2745956 | 4/1979 | Fed. Rep. of Germany | 405/184 |
| 2336520 | 7/1977 | France . | |
| 2113795 | 8/1983 | United Kingdom | 405/154 |
| 2137719 | 10/1984 | United Kingdom . | |

*Primary Examiner*—Cornelius J. Husar
*Assistant Examiner*—Nancy J. Stodola
*Attorney, Agent, or Firm*—Wegner & Bretschneider

[57] ABSTRACT

Apparatus for use in the laying and/or replacement of pipes underground comprises a sleeve having a front end and a rear end, a percussive drive means in the form of a pneumatically-operated impact mole mounted in the sleeve and arranged to drive the front end of said sleeve through the ground, means for securing the leading end of a pipe to the rear end of the sleeve and means for pushing the pipe through a bore formed in the ground as the sleeve is advanced through the ground by the mole. The means for securing the end of the pipe to the sleeve includes an annular spigot which allows relative axial movement to take place between the pipe and the sleeve in order to prevent impact stresses on the sleeve from the mole from being transmitted to the pipe. The pipe pushing means desirably comprise hydraulic rams arranged to bear on a plate located at the rear end of the pipe.

17 Claims, 4 Drawing Figures

PIPE LAYING AND REPLACEMENT

BACKGROUND OF THE INVENTION

This invention relates to apparatus for use in the laying and replacement of pipes underground.

It is known, for example, from British Patent Specification No. 2113795 to replace existing underground pipework by driving an expander into an existing pipeline with sufficient force to deform the pipe outwardly so that it is compressed into the surrounding ground by feeding a new pipe into the space formerly occupied by the existing pipeline.

An entirely new pipeline can be installed by the same method except that in this case the expander compresses the soil to form a passage therein for the pipe which is to be inserted.

In either case, the expander should be driven with sufficient force to ensure that the existing pipe or soil can be deformed radially outwardly and compressed into the surrounding material which may be concrete or soil.

A known apparatus for performing the above-described method of pipe replacement comprises a conical or frusto-conical member adapted to engage the end of an existing pipe with its smaller end having a smaller diameter than the internal diameter of the pipe and its larger end having a diameter which is at least as great as the external diameter of the pipe, a jacket secured to the larger end of the conical or frusto-conical member and means for driving the said member into the pipe to cause the latter to be forced radially outwards and compressed into the surrounding ground by the forward movement of the conical or frusto-conical member and jacket.

The other end of the jacket was provided with a locking ring which was screwed into the jacket, or to an interconnecting spacer member, and the leading end of a replacement pipe was secured to the locking ring by means of co-operating screw-threads.

The drive means took the form of a pneumatic percussive device referred to in the art as an impact mole. Such devices are driven through the ground by a series of impacts caused by a piston which is reciprocated within the mole casing. The following pipe is therefore dragged through the bore formed by the mole and is subjected to a succession of impact stresses as the piston repeatedly strikes the mole casing. These stresses can lead to weaknesses in and possible fracture of the pipe.

SUMMARY OF THE INVENTION

The object of the invention is to provide an apparatus for use in the laying and replacement of underground pipes which overcomes the above-mentioned disadvantage by avoiding tension and impact stresses on the leading end of a pipe which is being laid by the apparatus.

According to the invention, there is provided an apparatus for use in the laying and/or replacement of pipes underground which comprises a sleeve having a front end and a rear end, a percussive drive means mounted in said sleeve and arranged to drive the front end of said sleeve through the ground, means for securing the leading end of a pipe to the rear end of the sleeve and means for pushing the rear end of the pipe through a bore formed in the ground as said sleeve is advanced through the ground by the drive means, said means for securing the end of the pipe to the sleeve being mounted on said sleeve and being axially movable relative to said sleeve to allow relative axial movement to take place between the pipe and the sleeve in order to prevent impact stresses on the sleeve from said drive means from being transmitted to the pipe.

Preferably, the pipe is advanced through the bore by at least one hydraulic ram acting at or adjacent to the rear end of the pipe.

The percussive drive means desirably take the form of a pneumatically-operated impact mole.

According to a preferred embodiment of the invention, a nut is mounted on the rear end of the mole and is secured to the sleeve. At least one chain is secured to the nut and is led back through the pipe to the rear end thereof where it passes through a back plate arranged to bear against the rear end of the pipe. The pushing means are desirably provided with a slot adapted to receive one link of the chain whereby the chain can simply be dropped into said slot. A pair of hydraulic rams are arranged to act on the back plate in order to force the pipe along the bore formed by the sleeve. The purpose of the chain is to prevent the mole from running away and advancing through the ground in an uncontrolled manner.

In an alternative embodiment, a plurality of sets of hydraulic rams are provided which are arranged to act on the sides of a pipe. With this arrangement, the rams in one set can act to advance the pipe while the rams in another set are retracted for a further forwards movement. In this manner the pipe can be advanced continuously. However, this arrangement is really only suitable for pipes made up of long sections.

The sleeve may be provided with a series of radially extending fins which extend substantially throughout the axial length of the sleeve and which serve for bursting out an existing pipe which is to be replaced by a new pipe. The sleeve may be followed by a cone having a substantially smooth surface and secured to the sleeve. The leading end of the sleeve may be secured to a further cone which can serve as or which may be provided with a stability probe.

BRIEF DESCRIPTION OF THE DRAWINGS

The invention will now be further described, by way of example, with reference to the drawings, in which.

DESCRIPTION OF PREFERRED EMBODIMENT

Figure 1:
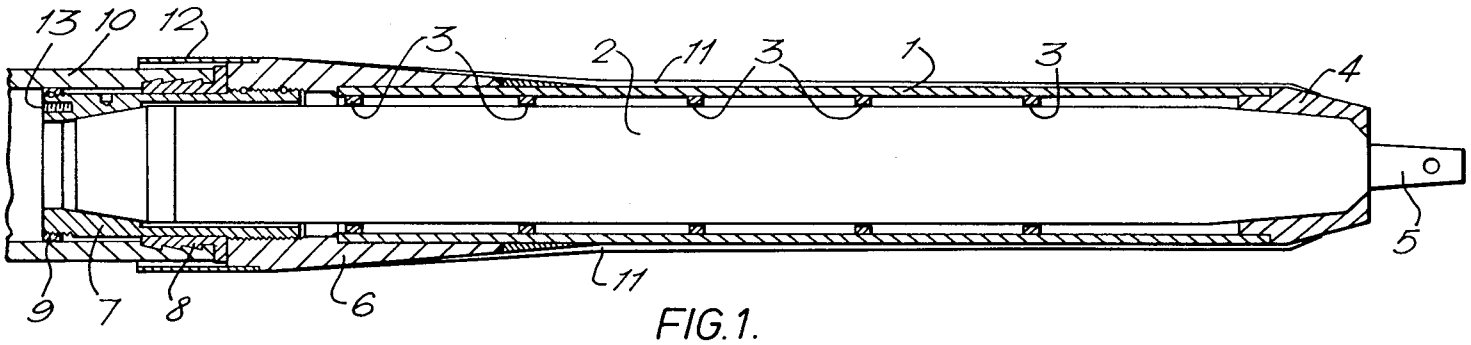
FIG. 1 is a longitudinal section through a sleeve forming part of an apparatus according to the invention, showing the leading end of a pipe secured to this part of the apparatus.

Reference will first be made to FIG. 1 of the drawings in which this part of the apparatus according to the invention comprises a sleeve 1 in which a pneumatically-operated impact mole 2 is mounted. The casing of the mole is spaced from the sleeve 1 by a series of spacer rings 3 and the front end of the mole 2 is arranged to act on a nose cone 4 which is secured to the leading end of the sleeve 1. The nose cone 4 and spacer rings 3 are desirably secured to the sleeve 1 by welding and a stability probe 5 projects from the front end of the casing of the mole 2 through the nose cone 4.

A rear cone 6 is fitted over the rear end of the sleeve 1 and secured thereto, e.g. by welding. The front end of the cone 6 is blended to the sleeve 1 by weld material to form a substantially smooth transition from the surface of the sleeve to that of the cone. The cone extends rearwardly beyond the rear end of the sleeve and surrounds the casing of the mole 2. Mounted over the rear end of the mole 2 and fitting within the rear end of the cone 6 is a rear nut 7 which is secured to the cone, e.g. by welding.

Slidably mounted on the rear nut 7 is an annular spigot 8 which is adapted to receive the leading end of a pipe 10. The spigot 8 is retained on the rear nut 7 by an end stop ring 9 which is screwed onto the rear end of said rear nut. A shield 12 which is adapted to surround the spigot 8 and the end of a pipe 10 mounted thereon is secured to the rear end of the cone 6. A series of fins 11 may be provided on the exterior surface of the sleeve 1 which fins may extend onto the front portion of the cone 6 as shown in FIG. 1. Finally, the rear nut 7 is provided with three screw-threaded bores 13 (only one shown in FIG. 1) which are spaced apart by 120° and are adapted to receive respective eye bolts (not shown).

Figure 2:
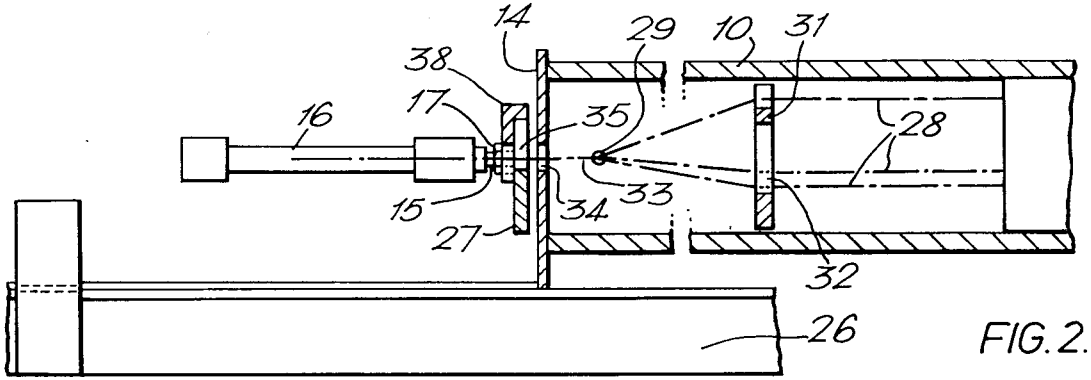
FIG. 2 is a longitudinal section through part of a pusher forming part of an apparatus according to the invention arranged to act on the rear end of the pipe the leading end of which is shown in FIG. 1.
Figure 3:
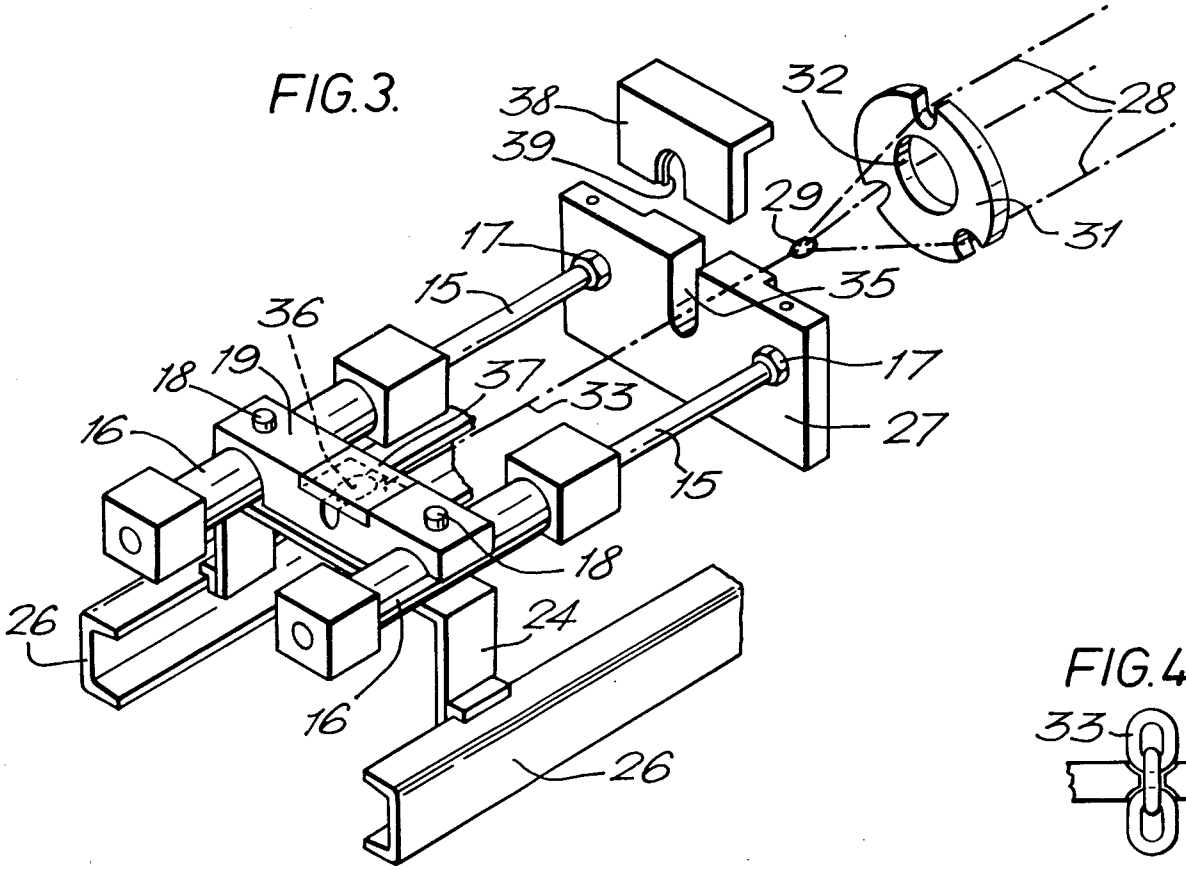
FIG. 3 is an exploded perspective view of parts of the pusher shown in FIG. 2.

Turning now to FIGS. 2 and 3 of the drawings, a back plate 14 is arranged to bear against the rear end of the pipe 10. This end of the pipe has not yet entered a bore made by the mole 2. The back plate is arranged to be acted on by the pistons 15 of two hydraulic rams 16 via a thrust plate 27 this plate being provided with bores through which the rods of said pistons extend and the piston rods being secured to the plate by means of lock nuts 17. The casings of the rams 16 are secured by clamps 18 to a bridge 19. A lower bridge 24 is secured to the ram casings and to the bridge 19 and rollers (not shown) are rotatably mounted on said lower bridge 24 and are arranged to run on rails 26.

Three chains 28 are each secured to a respective one of the eye bolts secured in the bores 13 (FIG. 1) and these chains are led through the pipe to the rear thereof at which a spacer plate 31 is located. The chains pass through slots in the periphery of the plate 31 and are connected together by a ring 29. The spacer plate 31 is provided with a central opening 32 to permit the passage of fluid lines leading to the mole 2 as well as control valves for controlling the operation of the mole.

Connected to the ring 29 is a further chain 33 which is led through slots 34 and 35 provided, respectively, in the back plate 14 and thrust plate 27 and which is located in a recess 36 provided in the bridge 19. The recess 36 is so shaped that one link of the chain 33 can be received in a central region of said recess so that the chain is positively located in the recess. The chain may be retained in placed by a plate 37 adapted to fit onto the bridge 19 in the region of the recess.

Figure 4:
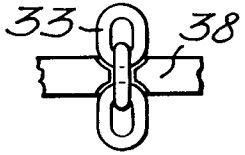
FIG. 4 shows a detail of a chain-locking device.

In operation of the apparatus, the chain 33 is tensioned by hand and the nearest available link is inserted into the recess 36. At this stage, the pistons 15 will usually be fully retracted into the rams 16. The rams are then activated to tension the chains 28 and 33 and a plate 38 provided with a recess 39 will then be fitted on the chain 33 adjacent to the thrust plate 27, one link of the chain being received in the recess 39 and the plate engaging the adjacent links as shown in FIG. 4. This serves to maintain the tension of the chain on the mole.

The apparatus can now be activated so that the mole commences to advance the sleeve 1 through the ground. It will be seen by reference to FIG. 1 that the mole and associated sleeve can advance by the distance between the rear of the spigot 8 and the front of the stop ring 9 before the leading end of the pipe 10 will be subjected to impact stresses from the mole. However, while the mole is operating, the chains 28 and 33, which are locked to the hydraulic rams 16 and hence to the back plate 14, act on the plate 14 at the rear end of the pipe to force the pipe through the ground. In addition, further hydraulic rams (not shown) act on the back plate 14 and also tend to force the pipe through the ground from the rear end of said pipe. If, as a result of the action of these rams, the chains should become slack because the rams have advanced the pipe at a greater rate than the travel of the mole through the ground, so that the distance between the rear of the spigot 8 and the front of the stop ring 9 is reduced, the hydraulic rams 16 can be actuated to tension the chain and to increase the said distance between the rear of the spigot 8 and the stop ring 9. The leading end of the pipe is therefore protected from the transmission of impact and tension stresses from the mole. Further, if the action of the mole and the said further hydraulic rams is synchronised, the rear end of the pipe receives only minimal impact stresses from the mole, the pipe mainly being advanced by a steady pushing action imparted by the rams.

The engagement of a link of the chain 33 in the recess 36 in the bridge 19 provides a quick and easy means for tensioning the chain, the full tensioning of the chain being achieved by means of the hydraulic rams 16 after a link of the chain has been inserted in the recess 36.

It will be seen that, by means of the apparatus according to the invention, pipes may be laid in the ground without being subjected to tension and impact stresses from an impact mole and are thus less likely to fracture.

The invention is not restricted to the above-described embodiment but variations and modifications may be made without departing from the scope of the invention. For example, three or more hydraulic rams may be provided instead of the two shown in the illustrated embodiment. These may be needed in the case of large diameter pipes.

It is also envisaged to provide sensors on the rear nut 7 which sense the position of the spigot 8 relative to said rear nut. The sensors will be connected to control means to stop actuation of the mole 2 when the spigot is close to the stop ring 9 and to actuate the mole 2 when the spigot is close to the rear of the cone 6. In this manner, operation of the mole can be accurately controlled and all risk of impact stresses being transmitted from the mole to the pipe can be avoided. With this arrangement, the operation of the mole and the said further hydraulic rams can be synchronized and it may be possible to dispense with the need for the tensioning chains thereby preventing all impact stresses from being transferred to the pipe.

I claim:

1. Apparatus for use in the laying and/or replacement of pipes underground said apparatus comprising a sleeve having a front end and a rear end, a percussive drive means mounted in said sleeve and arranged to drive the front end of said sleeve through the ground, means for securing the leading end of a pipe to the rear end of the sleeve and means for pushing the rear end of the pipe through a bore formed in the ground as said sleeve is advanced through the ground by said drive means, said means for securing the end of the pipe to the sleeve being mounted on said sleeve and being axially movable relative to said sleeve to allow relative axial movement to take place between the pipe and the sleeve in order to prevent impact stresses on the sleeve from said drive means from being transmitted to the pipe.

2. Apparatus as claimed in claim 1, in which said pushing means comprise at least one hydraulic ram.

3. Apparatus as claimed in claim 1, in which said sleeve is provided with a series of radially outwardly projecting fins.

4. Apparatus as claimed in claim 1, in which the front end of said sleeve is provided with a nose cone.

5. Apparatus as claimed in claim 4, in which a stability probe is arranged to project from said nose cone.

6. Apparatus as claimed in claim 1, in which the percussive drive means comprises a pneumatically-operated impact mole.

7. Apparatus as claimed in claim 6, in which the mole has a casing which is spaced from the sleeve by a plurality of spacer rings.

8. Apparatus as claimed in claim 6, in which a nut is mounted on the end of the mole, said nut being secured to the sleeve.

9. Apparatus as claimed in claim 8, in which at least one chain is secured to the nut and in which a back plate bears against the rear end of the pipe, said chain being led through the pipe to said rear end thereof and passing through said back plate.

10. Apparatus as claimed in claim 9, in which a plurality of chains are secured to said nut and in which a spacer plate is located in the pipe adjacent to but spaced from the rear end thereof, said chains passing over said spacer plate and then being connected together, a further chain extending from the connecting point of said plurality of chains through said back plate.

11. Apparatus as claimed in claim 9, in which a chain tensioning device is provided, said device having a slot receiving at least one link of the portion of the chain extending from the rear end of the pipe.

12. Apparatus as claimed in claim 11, in which a thrust plate is interposed between the back plate and the chain tensioning device.

13. Apparatus as claimed in claim 12, in which said pushing means includes a plurality of hydraulic rams acting on said thrust plate.

14. Apparatus as claimed in claim 13, in which said hydraulic rams are interconnected by bridge means in which the slot of said chain tensioning device is provided.

15. Apparatus as claimed in claim 8, in which a cone is mounted on the rear end of the sleeve, the nut being secured to said cone.

16. Apparatus as claimed in claim 15, in which an annular spigot is slidably mounted on said nut, said spigot receiving and engaging said leading end of a pipe and being retained on the nut by a stop ring mounted on said nut.

17. Apparatus as claimed in claim 16, in which a shield surrounds said annular spigot, said shield being secured to said cone at the rear end of the sleeve.

* * * * *